US006743078B2

(12) United States Patent
McClain et al.

(10) Patent No.: US 6,743,078 B2
(45) Date of Patent: Jun. 1, 2004

(54) METHODS, APPARATUS AND SLURRIES FOR CHEMICAL MECHANICAL PLANARIZATION

(75) Inventors: James B. McClain, Raleigh, NC (US); Joseph M. DeSimone, Chapel Hill, NC (US)

(73) Assignee: Micell Technologies, Inc., Raleigh, NC (US)

( * ) Notice: Subject to any disclaimer, the term of this patent is extended or adjusted under 35 U.S.C. 154(b) by 0 days.

(21) Appl. No.: 10/447,251

(22) Filed: May 28, 2003

(65) Prior Publication Data

US 2003/0194953 A1 Oct. 16, 2003

Related U.S. Application Data

(60) Division of application No. 09/816,956, filed on Mar. 23, 2001, now Pat. No. 6,623,355, which is a continuation-in-part of application No. 09/707,755, filed on Nov. 7, 2000, now abandoned.

(51) Int. Cl.[7] ..... B24B 1/00

(52) U.S. Cl. ..... 451/41; 451/60; 451/57; 451/37; 106/3; 216/88; 51/307

(58) Field of Search ..... 451/41, 60, 57, 451/37; 216/88, 89; 106/3, 491, 450, 499; 438/692, 693; 51/307, 309; 134/2; 516/99

(56) References Cited

U.S. PATENT DOCUMENTS

| | | | | |
|---|---|---|---|---|
| 4,921,635 A | * | 5/1990 | Enick | 516/99 |
| 5,302,233 A | | 4/1994 | Kim et al. | |
| 5,329,732 A | | 7/1994 | Karlsrud et al. | |
| 5,429,717 A | | 7/1995 | Bokstrom et al. | |
| 5,584,146 A | | 12/1996 | Shamouillan et al. | |
| 5,614,444 A | | 3/1997 | Farkas et al. | |
| 5,637,185 A | | 6/1997 | Murarka et al. | |
| 5,676,587 A | | 10/1997 | Landers et al. | |
| 5,700,383 A | | 12/1997 | Feller et al. | |
| 5,769,689 A | | 6/1998 | Cossaboon et al. | |
| 5,769,691 A | | 6/1998 | Fruitman | |
| 5,773,364 A | | 6/1998 | Farkas et al. | |
| 5,836,807 A | | 11/1998 | Leach | |
| 5,840,629 A | | 11/1998 | Carpio | |
| 5,863,307 A | | 1/1999 | Zhou et al. | |
| 5,866,005 A | | 2/1999 | DeSimone et al. | |
| 5,866,031 A | | 2/1999 | Carpio et al. | |

(List continued on next page.)

FOREIGN PATENT DOCUMENTS

| | | |
|---|---|---|
| CN | 397734 | 8/1987 |
| GB | 894 606 A | 4/1962 |

OTHER PUBLICATIONS

Coppeta, J. et al. *A Technique for Measuring Slurry–Flow Dynamics During Chemcial–Mechanical Polishing*, Materials Research Society Proceedings, Fall, Symposium L. (1996).

Coppeta. J. et al. *Characterizing Slurry Flow During CMP Using Laser Induced Fluorescence*, Second International Chemical Mechanical Polishing Planarization for ULSI Multilevel Interconnection Conference, Santa Clara, CA, Feb. (1997).

Coppeta J. et al. *Pad Effects on Slurry Transport Beneath a Wafer During Polishing*, Third International Chemical Mechanical Polish Planarization for ULSI Multilevel Interconnection Conference, Santa Clara, CA, Feb. (1998).

(List continued on next page.)

*Primary Examiner*—George Nguyen
(74) *Attorney, Agent, or Firm*—Myers Bigel Sibley & Sajovec

(57) ABSTRACT

Methods and apparatus for chemical mechanical planarization of an article such as a semiconductor wafer use polishing slurries including a carbon dioxide solvent or a carbon dioxide-philic composition. A carbon dioxide cleaning solvent step and apparatus may also be employed.

32 Claims, 3 Drawing Sheets

U.S. PATENT DOCUMENTS

| | | | | | |
|---|---|---|---|---|---|
| 5,897,375 | A | | 4/1999 | Watts et al. | |
| 5,916,012 | A | | 6/1999 | Pant et al. | |
| 5,922,833 | A | | 7/1999 | DeSimone | |
| 5,934,980 | A | | 8/1999 | Koos et al. | |
| 5,945,346 | A | | 8/1999 | Vanell et al. | |
| 5,958,288 | A | | 9/1999 | Mueller et al. | |
| 5,976,264 | A | * | 11/1999 | McCullough et al. | 134/2 |
| 5,998,279 | A | | 12/1999 | Liaw | |
| 6,001,418 | A | | 12/1999 | DeSimone et al. | |
| 6,007,406 | A | | 12/1999 | Custer et al. | |
| 6,019,806 | A | | 2/2000 | Sees et al. | |
| 6,020,262 | A | | 2/2000 | Wise et al. | |
| 6,030,663 | A | * | 2/2000 | McClain et al. | 427/389.9 |
| 6,040,245 | A | | 3/2000 | Sandhu et al. | |
| 6,046,112 | A | | 4/2000 | Wang | |
| 6,060,395 | A | | 5/2000 | Skrovan et al. | |
| 6,068,787 | A | | 5/2000 | Grumbine et al. | |
| 6,077,337 | A | | 6/2000 | Lee | |
| 6,083,840 | A | | 7/2000 | Mravic, deceased et al. | |
| 6,234,870 | B1 | * | 5/2001 | Uzoh et al. | 451/8 |
| 6,277,753 | B1 | | 8/2001 | Mullee et al. | |
| 6,331,487 | B2 | | 12/2001 | Koch | |
| 6,346,144 | B1 | | 2/2002 | Lee | |
| 6,447,563 | B1 | | 9/2002 | Mahulikar | |
| 6,471,735 | B1 | * | 10/2002 | Misra et al. | 51/308 |
| 6,623,355 | B2 | * | 9/2003 | McClain et al. | 451/60 |

OTHER PUBLICATIONS

Coppeta J. et al. *The Influence of CMP Process Parameters on Slurry Transport*, Fourth International Chemical Mechanical Polish Planarization for ULSI Multilevel Interconnection Conference, Santa Clara, CA, Feb. (1999).

Nishimoto, A. et al., *An in–situ sensor for reduced consumable usage through control of CMP*, SRC TechCon '98, Semiconductor Research Corporation, Las Vegas, NV, Sep. (1998).

Beery, D. et al. *Post Etch Residue Removal: Novel Dry Clean Technology Using Densified Fluid Cleaning* (*DFC*), IEEE, pp. 140–142, (1999).

Sarbu, T. et al. *Non–fluorous Polymers with Very High Solubility in Supercritical $CO_2$Down to Low Pressures*, Nature, 405:165–168 (2000).

*Chemical Mechanical Planarization Tries to Keep Up* [online]. Gorham Advanced Materials [cited Mar. 2, 2000]. Available from World Wide Web: <http://www.goradv.com/business>.

Semiconductor International. *CMP Grows in Sophistication* [online]. Cahners Business Information, Ruth Dejule, Associate Editor, Nov. 1998 [cited Oct. 30, 2000]. Available from World Wide Web: <http://www.semiconductor.net/semoconductor/issues/Issues/1998/nov98/docs/feature1.asp>.

*Teres™ CMP System* [online]. Lam Research [Cited Mar. 9, 2000]. Available from World Wide Web: <www.lamrc.com/inside/products/teres.html>.

*Meeting Agenda* [online]. San Antonio, Texas: The Electrochemical Society, M1—First International Symposium on Chemical Mechanical Planarization (CMP_ in IC Device Manufacturing, Oct. 6–11, 1996 [cited Mar. 2, 2000]. Available from World Wide Web: <www.electrochem.org/meetings/190/pim1.html>.

*Meeting Agenda* [online]. Anaheim, California: TMS Annual Meeting, Feb. 4–8, 1996 [cited Mar. 2, 2000]. Available from World Wide Web: <www.tms.org/Meetings/Annual–96/WednesPM9.html>.

*Course Information* [online]. AVS, Chemical Mechanical Planarization for Microelectronics Manufacturing [cite Mar. 2, 2000]. Available from World Wide Web: <www.vacuum.org/canada/cmp.html>.

*CMP World 99*[online]. Gorham/Intertech's Electronics Division [cited Mar. 2, 2000]. Available from World Wide Web: <www.intertechusa.com/Site/C . . s_99/CMP_World_99/cmp_world_99.htm>.

Steigerwald et al. Chemical Mechanical Planarization of Microelectronic Materials New York : J. Wiley, c1997 324 pages.

International Search Report for PCT/US01/48100, dated Apr. 26, 2002.

Decision of the Intellectual Property Office, Taiwanese Application No. 090127539, Feb. 11, 2003.

* cited by examiner

METHODS, APPARATUS AND SLURRIES FOR CHEMICAL MECHANICAL PLANARIZATION

RELATED APPLICATIONS

This application claims priority to and is a divisional of application Ser. No. 09/816,956 filed Mar. 23, 2001 U.S. Pat. No. 6,623,355, which is a continuation-in-part application of application Ser. No. 09/707,755, filed Nov. 7, 2000, now abandoned. The disclosures of these applications are hereby incorporated herein by reference in their entireties.

FIELD OF THE INVENTION

The present invention concerns methods and apparatus for the chemical-mechanical planarization of articles such as semiconductor wafers.

BACKGROUND OF THE INVENTION

Current trends in the integrated circuit (IC) industry include fabricating smaller devices having increased chip density. Reducing chip size can reduce chip manufacturing costs. In addition, devices having smaller dimensions can be advantageous because device delay can also be decreased, thereby increasing performance.

In addition, device performance can be increased by adding multiple levels of metallization. The use of multiple levels of metal interconnections allows for wider interconnect layer dimensions with shorter interconnect lengths. Because such lengths have only been possible with single level devices, a corresponding decrease in interconnect delay has been achieved. Nonetheless, as many interconnect levels are added, topography that builds up with each level can become severe. If not resolved, these topographies can adversely affect the reliability of the device.

As circuit dimensions are reduced, interconnect levels must be globally planarized to produce a reliable, high density device. Chemical mechanical planarization (CMP) is rapidly becoming the technique of choice for planarizing interlevel dielectric (ILD) layer surfaces and for delineating metal patterns in integrated circuits. See, e.g., U.S. Pat. No. 5,637,185 to Muraka et al.

In general, CMP processes involve holding or rotating a semiconductor wafer against a rotating wetted polishing surface under a controlled downward pressure. A chemical slurry containing a polishing agent, such as alumina or silica, is typically used as the abrasive medium. Additionally, the chemical slurry can contain chemical etchants for etching various surfaces of the wafer. In a typical fabrication of a device, CMP is first employed to globally planarize an ILD layer surface comprising only dielectric. Trenches and vias are subsequently formed and filled with metal by known deposition techniques. CMP is then typically used to delineate a metal pattern by removing excess metal from the ILD. See Murakara, supra.

One problem with CMP is the generation of expansive fluid streams that require handling and waste management. For example, problems may be presented by the toxicity of the slurries, of potentially metal containing slurry effluent, and of contaminated cleaning solutions used post-polishing or post-planarization. Water consumption during CMP is estimated to range from 10 to 20 gallons per processed wafer. CMP waste consists of highly toxic chemicals, and there has been little progress in finding methods of converting CMP waste to more manageable forms. See generally, "Chemical Mechanical Planarization Tries to Keep Up", Gorham Advanced Materials, (Mar. 2, 2000). A non-aqueous CMP polishing slurry is described in U.S. Pat. No. 5,863,307 to Zhou et al., but this slurry preferably employs carbon tetrachloride. Accordingly, there is a need for new approaches to carrying out chemical mechanical planarization, and new formulations for CMP polishing slurries.

Another problem is the potential for contamination of substrates through the use of water. Such contamination may include unwanted/unclaimed oxidation or trace ions or residual water affecting dielectric layers, expecially CVD layers, spin on layers and porous layers.

SUMMARY OF THE INVENTION

The present invention is based upon the development of CMP polishing slurries that contain carbon dioxide as a solvent and polishing slurries including carbon dioxide-philic compositions, either alone or in combination with one or more additional cosolvents, as well as methods using such slurries and, in some embodiments, carbon dioxide solvent cleaning. Inclusion of the carbon dioxide provides a solvent media that may be easily separated from other ingredients of the slurry or cleaning solvent, thereby reducing the volume of slurry or cleaning solvent for subsequent waste disposal.

According to preferred methods of the present invention, a method for the chemical mechanical planarization of a surface of an article such as a semiconductor wafer includes: providing a polishing slurry including carbon dioxide; providing a polishing pad; and contacting the polishing pad and the polishing slurry against the surface of the article (e.g., wafer) to thereby planarize the surface of the article. The contacting step can be carried out in an atmosphere comprising carbon dioxide at a pressure greater than atmospheric pressure.

The method may include the step of cleaning the surface of the article (e.g., wafer) using a carbon dioxide solvent following the contacting step.

The method may include rotating at least one of the pad and the article relative to the other. The article may be rotated in a first direction with the pad being rotated in a counter direction. The article may be held in a static position. The pad may include a continuous linear belt pad which may be linearly moved relative to the article.

The article (e.g., wafer) may be disposed in a pressure vessel during each of the steps of providing a polishing slurry, providing a polishing pad, and contacting the polishing pad and the polishing slurry against the surface of the article. The method may further include distilling at least a portion of the polishing slurry at a pressure greater than atmospheric pressure to separate the carbon dioxide from the remainder of the polishing slurry.

According to further preferred methods of the present invention, a method for the chemical mechanical planarization of a surface of an article such as a semiconductor wafer includes: providing a carbon dioxide-philic polishing slurry; providing a polishing pad; contacting the, polishing pad and the polishing slurry against the surface of the article to thereby planarize the surface of the article; and cleaning the surface of the article with a solvent comprising carbon dioxide.

The contacting step may be executed in an atmosphere not including carbon dioxide in an amount exceeding common atmospheric conditions. The contacting step and the cleaning step may be executed in a common pressure vessel. The polishing slurry may include a polymer that is soluble in carbon dioxide.

According to further preferred methods of the present invention, a method for the chemical mechanical planarization of a surface of an article such as a semiconductor wafer includes: providing a carbon dioxide-philic polishing slurry; providing a polishing pad; and contacting the polishing pad and the polishing slurry against the surface of the article to thereby planarize the surface of the article. The contacting step may be executed in an atmosphere comprising carbon dioxide at a pressure greater than atmospheric pressure.

According to preferred embodiments of the present invention, an apparatus for the chemical mechanical planarization of a surface of an article such as a semiconductor wafer includes a polishing pad; a polishing slurry including carbon dioxide; and an article holding member to hold the article such that the surface of the article can be contacted with the polishing pad and the polishing slurry.

According to further preferred embodiments of the present invention, an apparatus for the chemical mechanical planarization of a surface of an article Such as a semiconductor wafer includes a polishing pad; a carbon dioxide-philic polishing slurry; and an article holding member to hold the article such that the surface of the article can be contacted with the polishing pad and the polishing slurry.

A further aspect of the present invention is a CMP polishing slurry, comprising: (a) abrasive particles (e.g., from 1 to 20 percent by weight); and (b) optionally, but preferably, an etchant (e.g., from 0 or 0.1 to 50 or 70 percent by weight); and (c) carbon dioxide solvent (preferably dense carbon dioxide, and more preferably liquid carbon dioxide) (e.g., at least 20 or 30 percent by weight).

A further aspect of the present invention is a $CO_2$-philic CMP polishing slurry, comprising: (a) abrasive particles (e.g. from 1 to 20 percent by weight); (b) etchant (e.g., from 0.1 to 50 percent by weight); (c) solvent (e.g., at least 30 percent by weight); and (d) a carbon-dioxide soluble polymer (e.g., from 1 to 20 or 30 percent by weight).

Objects of the present invention will be appreciated by those of ordinary skill in the art from a reading of the Figures and the detailed description of the preferred embodiments which follow, such description being merely illustrative of the present invention.

DETAILED DESCRIPTION OF THE PREFERRED EMBODIMENTS

Figure 1:
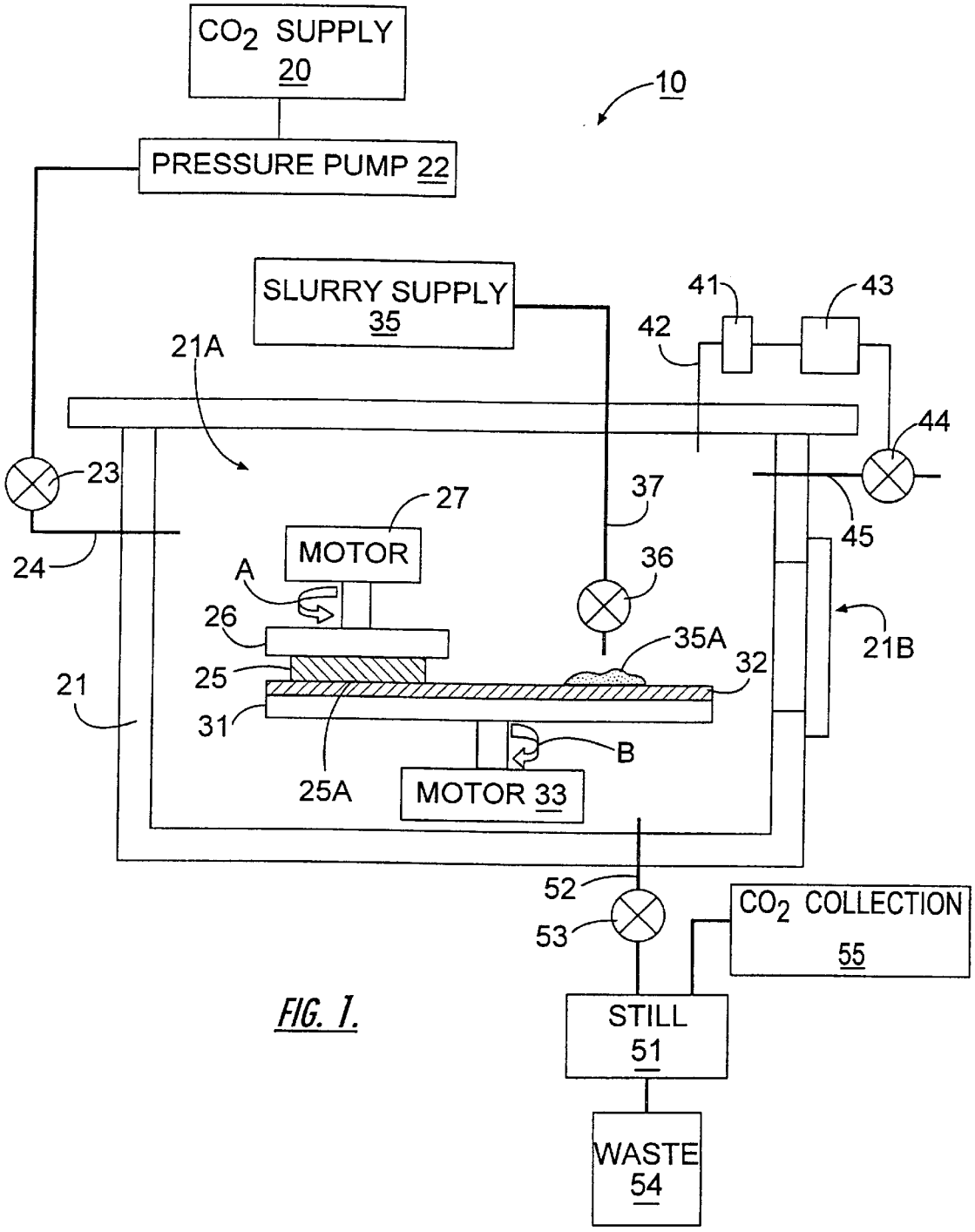
FIG. 1 is a schematic illustration of an apparatus of the present invention, with the planarization steps being carried out with a rotating pad within a pressure vessel.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

In general, the invention can be used for the fabrication of articles such as integrated circuits (ICs), including, for example, memory ICs such as random access memories (RAMs), dynamic random access memories (DRAMs), or synchronous DRAMs (SDRAMs). The ICs may also include other types of circuits such as application specific ICs (ASICs), merged DRAM-logic circuits (embedded DRAMs), other logic circuits, etc.

The invention may be used to provide CMP of or for, inter alia, deep trench capacitor fabrication, shallow trench isolation, polysilicon films, photoresists and superconducting circuits. The CMP of the present invention may be used for planarizing Al, Al alloys, polymers, inlaid metal, diffusion barriers and adhesion promoters. The present invention may also be used to planarize both the dielectric layers and metal layers/plugs/lines in a damascene or dual damascene process. In particular, the CMP of the present invention may be employed to form IC's with copper interconnects using a damascene or dual damascene process.

"Carbon dioxide" as used in the present invention is preferably dense carbon dioxide (which may be in any suitable form such as those described below). In the case where carbon dioxide is used in the slurry composition, the carbon dioxide is more preferably liquid carbon dioxide. In the case where carbon dioxide is used for cleaning, the carbon dioxide is more preferably a compressed liquid or supercritical carbon dioxide (including near supercritical carbon dioxide). The carbon dioxide may optionally be mixed with cosolvents and/or other ingredients as also described in greater detail below.

"Dense carbon dioxide" is a fluid comprising carbon dioxide at temperature and pressure conditions such that the density is above the critical density (typically the maximum pressure will be less than 1,000 bar and the maximum temperature will be less than 250° C.).

"Liquid carbon dioxide" herein refers to dense carbon dioxide at vapor-liquid equilibrium (VLE) conditions (i.e., there is a gas-liquid interface), including conditions commonly referred to as cryogenic conditions of approximately −20 to 0° F., and 250 to 300 psigg.

"Compressed liquid carbon dioxide" refers to dense carbon dioxide (which may contain other constituents) that is pressurized above the VLE conditions of pure $CO_2$ (in the case of pure $CO_2$, the gas-liquid interface is gone. However, one may compress liquid $CO_2$ with an alternate fluid such as Nitrogen gas, Helium gas, liquid water, etc.).

"Supercritical carbon dioxide" refers to dense carbon dioxide at conditions above the critical T and critical P.

"Near supercritical carbon dioxide" refers to dense carbon dioxide within about 85% of absolute critical T and critical P.

"Chemical Mechanical Planarization" (CMP) as used herein refers to a process of smoothing and/or improving the planarity of a surface of a substrate, aided by chemical and mechanical forces. Thus CMP as used herein includes polishing procedures in which a surface is smoothed, although not necessarily planarized, as well as procedures in which the surface is both smoothed and planarized.

"Contacting" as used herein to describe the contacting of a CMP pad to an article such as a semiconductor substrate to be planarized includes directly contacting (i.e., the load between the pad and the article is supported almost entirely by pad-wafer contact), semi-directly contacting (i.e., the load is supported partially by pad-wafer contact and partially by fluid-dynamic pressure on the slurry between the pad and the wafer), and fluid-planing (i.e., the load is supported entirely by a continuous fluid layer of slurry between the pad and the wafer).

A "slurry" as described herein comprises a combination of ingredients in a solvent for use in chemical mechanical planarization. The slurry may take any suitable form (for example, may have two or three separate phases including multiple liquid phases, multiple solid phases or mixtures thereof, or gases mixed with liquids and/or solids, especially compressed gases or liquified gases), such as a suspension, dispersion, emulsion, microemulsion, inverse emulsion, inverse microemulsion, combination thereof, etc. In one embodiment the slurry may be a water in carbon dioxide emulsion or microemulsion (with the carbon dioxide optionally containing co-solvents or other ingredients therein). Such an emulsion or microemulsion may further contain abrasive particles suspended as a separate third phase therein.

As will be understood by those of skill in the art from the description herein, the apparatus, slurries and methods described herein may affect polishing and planarizing of an article (e.g., a semiconductor wafer) using one or more, and preferably all, of the following mechanisms. Solid particles may be used as abrasives that are driven across the surface of the article to remove material from the article surface by transfer of force. The abrasive particles may be delivered through the selected fluid/slurry or may be provided in or on the pad (whether as an additive to the pad or as an inherent feature of the selected pad base material). The removal force may be imparted to the abrasive particles by moving a pad and/or the article relative to one another, providing a flow of the fluid/slurry, or combinations of these. Polishing and planarization may also be achieved by chemical action, i.e., selected active chemical components used in the CMP process chemically attack some or all of the article's surface. The active chemical components may take the form of a liquid, solid and/or gas and may be provided in the slurry, the atmosphere and/or the pad.

Applicants specifically intend that all patent references cited herein be incorporated by reference herein in their entirety.

1. Articles for CMP.

Any suitable article may be planarized by the methods of the present invention, such as semiconductor devices or wafers (e.g., in the production integrated circuits). In general, a semiconductor substrate provides support for subsequent layers of the semiconductor device or wafer. The substrate may be formed of any suitable material known to the skilled artisan, including silicon, silicon oxide, gallium arsenide, etc. An insulating layer such as a layer of silicon dioxide ($SiO_2$), is usually formed on the substrate, and typically includes trenches etched therein. A layer such as a conducting metal layer such as copper may be deposited onto the surface of the insulating layer in the trenches, in accordance with known techniques.

Typically, numerous ICs are formed on the wafer in parallel. After processing (including CMP as described herein) is finished, the wafer is diced to separate the integrated circuits to individual chips. The chips are then packaged, resulting in a final product that is used in, for example, computer systems, cellular phones, personal digital assistants (PDAs), and other electronic products.

Any of a variety of particular materials may be exposed on the surface of the article or substrate for planarization. Thus suitable materials that may be polished or planarized by the methods of the present invention include, but are not limited to, metals (e.g., Al, Cu, Ta, Ti, TiN, $TiN_xC_y$, W, Cu alloys, Al alloys, polysilicon, etc.), dielectrics (e.g., $SiO_2$, BPSG, PSG, polymers, $Si_3N_4$, $SiO_xN_y$, foams, aerogels, etc.), indium tin oxide, high K dielectrics, high $T_c$ superconductors, optoelectronic materials, optical mirrors, optical switches, plastics, ceramics, silicon-on-insulator (SOI), etc. See, e.g., J. Steigerwald et al., Chemical Mechanical Planarization of Microelectronic Materials, pg. 6 (1997) (ISBN 0-471-13827-4).

Thus in certain particular embodiments of the invention, the surface to be planarized comprises a group III through group VIII metal such as V, Ni, Cu, W, Ta, Al, Au, silver, platinum, palladium, etc.

In particular embodiments of the present invention, the surface of the substrate or article to be planarized comprises copper, such as in a damascene or dual-damascene copper device.

In further embodiments of the present invention, the surface of the article comprises a layer or sections of a layer that have been oxidized such as with a plasma.

2. Carbon Dioxide CMP Polishing Slurries ($CO_2$-Based Slurries).

For certain processes according to the present invention as described herein, a carbon dioxide-based CMP polishing slurry (hereinafter "$CO_2$-based slurry") is employed. The $CO_2$-based slurry may be a dispersion or slurry in $CO_2$, cosolvent modified $CO_2$ or surfactant modified $CO_2$. Preferably, the $CO_2$-based slurry is a dispersion or slurry in dense $CO_2$, and more preferably, in liquid $CO_2$. The $CO_2$-based slurry will typically include various other CMP enabling or facilitating components. As noted above, a CMP polishing slurry typically includes abrasive particles, a solvent, and (optionally but preferably) an etchant. Each of these ingredients, along with other common additional ingredients, is discussed in greater detail below.

Abrasive particles. The term "particle" as used herein includes aggregates and other fused combinations of particles, as well as agglomerates and other solely mechanically interwoven combinations of particles. To achieve sufficiently rapid polishing without deleterious scratching of the semiconductor wafer, the abrasive particles preferably have a mean particle diameter of from about 10 nanometers to about 800 nanometers, and more preferably a mean particle diameter of from about 10 nanometers to about 300 nanometers. The abrasive is typically included in the slurry in an amount ranging from about 1 or 3 to about 7 or 20 percent by weight. The abrasive particles may be dispersed in the slurry with the surfactants and/or rheology modifiers discussed below.

The abrasive particles may be formed from any suitable material, including, but not limited to, silica (including both fumed silica and colloidal silica), metals, metal oxides, and combinations thereof. Silica and alumina abrasives are common and may be used, alone or in combination. Ceria abrasives which exhibit a chemical tooth property may be used in some applications where desired. In one embodiment, the abrasive particles are formed of at least one metal oxide abrasive selected from the group consisting of alumina, ceria, germania, silica, titania, zirconia, and mixtures thereof. In certain embodiments the abrasive particles may comprise ice particles (e.g., when the slurry is a water-in-carbon dioxide emulsion or microemulsion) or dry ice particles (e.g., created by rapid expansion of liquid $CO_2$ or of a supercritical solvent, or "RESS").

Etchants. The CMP polishing slurry optionally but preferably includes at least one active chemistry, commonly referred to as an etchant, or combination of etchants. An "etchant" is any material that chemically removes material from the semiconductor wafer, or chemically facilitates the removal of material from the semiconductor wafer by physical means (i.e., polishing with the abrasive particles). In some embodiments, the etchant is an oxidizing agent.

When present, the etchant or etchants are generally included in an amount of from 0.01, 0.1, or 1 to 10, 20, 50 or 70 percent by weight of the slurry composition, depending upon the particular workpiece being planarized and depending on the aggressiveness of the particular etchant.

Etchants may be included in the slurry in gaseous, liquid or solid form. When included in solid form, the etchants are preferably in particles that have a mean particle diameter of from 10 to 300 or 800 nanometers. The slurry may be delivered from and/or through the pad. The etchant may also be present in the pad. When included in liquid or gaseous form, the etchants may or may not be miscible in the carbon dioxide solvent (which may or may not include cosolvents as described below).

Examples of suitable etchants include, but are not limited to the following:

(A) Acids, including organic and inorganic acids such as acetic acid, nitric acid, perchloric acid, and carboxylic acid compounds such as lactic acid and lactates, malic acid and malates, tartaric acid and tartrates, gluconic acid and gluconates, citric acid and citrates, ortho di- and polyhydroxybenzoic acids and acid salts, phthalic acid and acid salts, pyrocatecol, pyrogallol, gallic acid and gallates, tannic acid and tannates, etc.

(B) Bases, typically hydroxides such as ammonium hydroxide, potassium hydroxide and sodium hydroxide (bases are less preferred when carbon dioxide is a major ingredient in the slurry due to acid-base interactions and reactions).

(C) Fluorides, such as potassium fluoride, hydrogen fluoride, etc.

(D) Inorganic or organic per-compounds, (i.e., compounds containing at least one peroxy group (—O—O—) or a compound containing an element in its highest oxidation state, such as hydrogen peroxide ($H_2O_2$) and its adducts such as urea hydrogen peroxide and percarbonates, organic peroxides such as benzoyl peroxide, peracetic acid, di-t-butyl peroxide, monopersulfates, dipersulfates, and sodium peroxide. Examples of compounds containing an element in its highest oxidation state include but are not limited to periodic acid, periodate salts, perbromic acid, perbromate salts, perchloric acid, perchloric salts, perboric acid, and perborate salts and permanganates. Examples of non-per compounds that meet the electrochemical potential requirements include but are not limited to bromates, chlorates, chromates, iodates, iodic acid, and cerium (IV) compounds such as ammonium cerium nitrate. See, e.g. U.S. Pat. No. 6,068,787 to Grumbine et al.

(E) oxidants or oxidizing agents such as oxone, $NO_3^-$, $Fe(CN)_6^{3-}$, etc.

Additional examples of etchants include, but are not limited to, ammonium chloride, ammonium nitrate, copper (II) nitrate, potassium ferricyanide, potassium ferricyanide, benzotriazole, etc.

Carboxylate salts. The CMP polishing slurry may optionally contain a carboxylate salt when used for the planarization of certain materials Such as copper. See, e.g., U.S. Pat. No. 5,897,375 to Watts et al. Carboxylate salts include citrate salts such as one or more of ammonium citrate and potassium citrate. An optional triazole compound such as 1,2,4-triazole may also be added to the slurry (e.g., in an amount by weight of from 0.01 to 5 percent) to improve planarization of materials such as copper.

Cosolvents. The CMP polishing slurry may optionally contain one or more cosolvents. Cosolvents that may be used in conjunction with the carbon dioxide solvent include both polar and non-polar, protic and aprotic solvents, such as water and organic co-solvents. The organic co-solvent is, in general, a hydrocarbon co-solvent. Typically the co-solvent is an alkane, alcohol or ether-co-solvent, with $C_{10}$ to $C_{20}$ linear, branched, and cyclic alkanes, alcohols or ethers, and mixtures thereof (preferably saturated) currently preferred. The organic co-solvent may be a mixture of compounds, such as mixtures of alkanes as given above, or mixtures of one or more alkanes. Additional compounds such as one or more alcohols (e.g., from 0 or 0.1 to 5% of a C1 to C15 alcohol such as isopropyl alcohol (including diols, triols, etc.)) different from the organic co-solvent may be included with the organic co-solvent.

Examples of suitable co-solvents include, but are not limited to, aliphatic and aromatic hydrocarbons, and esters and ethers thereof, particularly mono and di-esters and ethers (e.g., EXXON ISOPAR L, ISOPAR M, ISOPAR V, EXXON EXXSOL, EXXON DF 2000, CONDEA VISTA LPA-170N, CONDEA VISTA LPA-210, cyclohexanone, and dimethyl succinate), alkyl and dialkyl carbonates (e.g., dimethyl carbonate, dibutyl carbonate, di-t-butyl dicarbonate, ethylene carbonate, and propylene carbonate), alkylene and polyalkylene glycols, and ethers and esters thereof (e.g., ethylene glycol-n-butyl ether, diethylene glycol-n-butyl ethers, propylene glycol methyl ether, dipropylene glycol methyl ether, tripropylene glycol methyl ether, and dipropylene glycol methyl ether acetate), lactones (e.g., (gamma)butyrolactone, (epsiglon)caprolactone, and (delta) dodecanolactone), alcohols and diols (e.g., 2-propanol, 2-methyl-2-propanol, 2-methoxy-2-propanol, 1-octanol, 2-ethyl hexanol, cyclopentanol, 1,3-propanediol, 2,3-butanediol, 2-methyl-2,4-pentanediol) and polydimethylsiloxanes (e.g., decamethyltetrasiloxane, decamethylpentasiloxane, and hexamethyldisloxane), etc.

Additional cosolvents include DMSO, mineral oil, terpenes such as limonene, vegetable and/or plant oils such as soy or corn oil, derivatives of vegetable oils such as methyl soyate, NMP, halogenated alkanes (e.g., hydrochlorofluorocarbons, perfluorocarbons, brominated alkanes, and chlorofluorocarbons) and alkenes, alcohols, ketones and ethers. The cosolvent may be a biodegradable cosolvent such as ARIVASOL™ carrier fluid (available from Uniqema, Wilmington, Del. USA, a subsidiary of ICI). Mixtures of the above co-solvents may be used.

Slurries used herein may be aqueous or nonaqueous (water-free). Slurries that are predominantly $CO_2$ slurries (with or without other cosolvents) may contain some water to participate in the chemical component of the CMP, such as softening of oxide surfaces. Thus the slurry may comprise from 0, 0.01, 0.1 or 1 to 2, 5, 10 or 20 percent by weight water or more, depending upon the particular application of the slurry.

Chelating agents. The slurry may contain chelating agents (or counter-ions) to facilitate the removal of ions, such as metal ions. Chelating agents may be included in the slurry in any suitable amount (e.g., 0.001, 0.01, or 0.1 to 1, 5, 10 or 20 percent by weight or more) depending upon the particular material being planarized and the intended use of the article being planarized. In general, chelating agents and counter-ions are mono-coordinating or poly-coordinating compounds that contain one or more oxygen, nitrogen, phosphorous and/or sulfur coordinating atoms. In certain embodiments the chelating agent may itself be a solvent or co-solvent. Depending upon the embodiment of the invention, the chelating agent may itself be soluble in carbon dioxide. Examples of suitable chelating agents or counter-ions include, but are not limited to, crown ethers, porphyrins and porphyrinic macrocycles, tetrahydrofuran, dimethylsulfoxide, EDTA, boron-containing compounds such as BARF, etc. Examples are given in U.S. Pat. No. 5,770,085 to Wai et al.

The chelating agent may comprise a chelating group coupled to (e.g., covalently coupled to) a $CO_2$-philic group. Suitable $CO_2$-philic groups include the $CO_2$-soluble polymers described herein. Suitable examples are given in U.S. Pat. No. 5,641,887 to Beckman et al. and U.S. Pat. No. 6,176,895 to DeSimone et al. (PCT WO 00/26421). Thus in one preferred embodiment the chelating agent comprises: a polymer (such as a fluoropolymer or siloxane polymer) having bound thereto a ligand that binds the metal (or a metalloid), with the ligand preferably bound to said polymer at a plurality of locations along the chain length thereof. Suitable ligands include, but are not limited to, β-diketone, phosphate, phosphonate, phosphinic acid, alkyl and aryl phosphine oxide, thiophosphinic acid, dithiocarbamate, amino, ammonium, hydroxyoxime, hydroxamic acid, calix (4)arene, macrocyclic, 8-hydroxyquinoline, picolylamine, thiol, carboxylic acid ligands, etc.

In general, metal particles (as opposed to metal ions) are not chelated. Like most particles, they can be sterically stabilized and dispersed with surfactants, such as surfactants described herein. A chelate is a coordination compound represented by a single metal atom (typically an ion) attached to an organic ligand by coordinate linkages to two or more non-metal atoms in the same molecule. The smallest of particles may represent billions of metal atoms that cannot be chelated until the each atom is oxidized, then dissolved and coordinated. Chelation typically takes place in environments that can kinetically support the oxidation and dissolution process. Thus when chelation is to be carried out the solvent, carrier or wash fluid typically contains constituents that make chelation work (such as: water, polar protic cosolvents, oxidants, etc). Metal particle removal can be facilitated by means such as $CO_2$-philic surfactants that interact with metal particles because of favorable interstatic attraction between the metal particles/clusters and a portion of the surfactant. This interaction helps disperse and suspend the particle in the fluid medium.

Copper CMP slurry formations may contain dissolved $NH_3$ to complex the copper ions and increase copper solubility, for example by adding $NH_4OH$ and/or $NH_4NO_3$ to the slurry.

Surfactants. Surfactants that may be used in the present invention include those that contain a $CO_2$-philic group (particularly for a carrier or wash that comprises $CO_2$), and/or those that do not contain a $CO_2$-philic group (e.g., when the carrier or wash contains a co-solvent, or does not contain $CO_2$). Examples are given in U.S. Pat. No. 5,858,022 to Romack et al. Surfactants that contain a $CO_2$-philic group may comprise that group covalently coupled to a hydrophilic group, a lipophilic group, or both a hydrophilic group and a lipophilic group. Surfactants may be employed individually or in combination. In general, the amount of surfactant or surfactants included in a composition (planarizing or wash) is from about 0.01, 0.1 or 1 percent by weight up to about 5, 10 or 20 percent by weight.

Surfactants that contain a $CO_2$-philic group coupled to a hydrophilic or lipophilic group are known. Additional examples of such surfactants that may be used in the present invention include but are not limited to those are given in U.S. Pat. No. 5,866,005 to DeSimone et al., U.S. Pat. No. 5,789,505 to Wilkinson et al., U.S. Pat. No. 5,683,473 to Jureller et al., U.S. Pat. No. 5,683,977 to Jureller et al.; U.S. Pat. No. 5,676,705 to Jureller et al. Examples of suitable $CO_2$-philic groups include fluorine-containing polymers or segments, siloxane-containing polymers or segments, poly (ether-carbonate)-containing polymers or segments, acetate polymers or acetate containing segments such as vinyl acetate-containing polymers or segments, poly (ether ketone)-containing polymers or segments and mixtures thereof. Examples of such polymers or segments include, but are not limited to, those described in U.S. Pat. No. 5,922,833 to DeSimone; U.S. Pat. No. 6,030,663 to McClain et al.; and T. Sarbu et al., *Nature* 405, 165–168 (11 May 2000). Examples of hydrophilic groups include, but are not limited to, ethylene glycol, polyethylene glycol, alcohols, alkanolamides, alkanolamines, alkylaryl sulfonates, alkylaryl sulfonic acids, alkylaryl phosphates, alkylphenol ethoxylates, betaines, quarternary amines, sulfates, carbonates, carbonic acids, etc. Examples of lipophilic groups include, but are not limited to, linear, branched, and cyclic alkanes, mono and polycyclic aromatic compounds, alkyl substituted aromatic compounds, polypropylene glycol, polypropylene aliphatic and aromatic ethers, fatty acid esters, lanolin, lecithin, lignin derivatives, etc.

Conventional surfactants may also be used, alone or in combination with the foregoing. Numerous surfactants are known to those skilled in the art. See, e.g., McCutcheon's Volume 1: Emulsifiers & Detergents (1995 North American Edition) (MC Publishing Co., 175 Rock Road, Glen Rock, N.J. 07452). Examples of the major surfactant types that can be used in the present invention include the: alcohols, alkanolamides, alkanolamines, alkylaryl sulfonates, alkylaryl sulfonic acids, alkylbenzenes, amine acetates, amine oxides, amines, sulfonated amines and amides, betaine derivatives, block polymers, carboxylated alcohol or alkylphenol ethoxylates, carboxylic acids and fatty acids, diphenyl sulfonate derivatives, ethoxylated alcohols, ethoxylated alkylphenols, ethoxylated amines and/or amides, ethoxylated fatty acids, ethoxylated fatty esters and oils, fatty esters, fluorocarbon-based surfactants, glycerol esters, glycol esters, hetocyclic-type products, imidazolines and imidazoline derivatives, isethionates, lanolin-based derivatives, lecithin and lecithin derivatives, lignin and lignin deriviatives, maleic or succinic anhydrides, methyl esters, monoglycerides and derivatives, olefin sulfonates, phosphate esters, phosphorous organic derivatives, polyethylene glycols, polymeric (polysaccharides, acrylic acid, and acrylamide) surfactants, propoxylated and ethoxylated fatty acids alcohols or alkyl phenols, protein-based surfactants, quaternary surfactants, sarcosine derivatives, silicone-based surfactants, soaps, sorbitan derivatives, sucrose and glucose esters and derivatives, sulfates and sulfonates of oils and fatty acids, sulfates and sulfonates ethoxylated alkylphenols, sulfates of alcohols, sulfates of ethoxylated alcohols, sulfates of fatty esters, sulfonates of benzene, cumene, toluene and xylene, sulfonates of condensed naphthalenes, sulfonates of dodecyl and tridecylbenzenes, sulfonates of naphthalene and alkyl naphthalene, sulfonates of petroleum, sulfosuccinamates, sulfosuccinates and derivatives, taurates, thio and mercapto derivatives, tridecyl and dodecyl benzene sulfonic acids, etc.

Rheology modifiers. In certain embodiments the slurry may contain one or more ingredients that alter the rheology thereof, and particularly ingredients that increase the viscosity thereof. Particles such as abrasives described above may work alone as rheology modifiers or may function in combination with other rheology modifiers such as polymers (including $CO_2$-soluble polymers as described below) and surfactants. In general, liquid carbon dioxide has a viscosity of about 0.1 centiPoise (cP). Thus in certain embodiments of the invention the slurry may be from 1, 10, 20 or 50 cP up to about 1,000, 10,000 or even 100,000 cP in viscosity.

Other slurry ingredients. Other known polishing slurry additives may be incorporated alone or in combination into the polishing slurries described herein. A non-inclusive list is corrosion inhibitors, dispersing agents, and stabilizers. Catalysts to transfer electrons from the metal being oxidized to the oxidizer (when an oxidizer is employed as the etchant for the removal of metal), or analogously to transfer electrochemical current from the oxidizer to the metal, may be employed as described in U.S. Pat. No. 6,068,787 to Grumbine et al.). Chelating agents include ethylenediaminetetraacetic acid (EDTA), N-hydroxyethylethylenediaminetriacetic acid (NHEDTA), nitrolotriacetic acid (NTA), diethylklene-triaminepentacetic acid (DPTA), ethanoldiglycinate, and the like. Corrosion inhibitors include benzotriazole (BTA) and tolyl triazoles (TTA). Numerous other slurry ingredients and additives will be readily apparent to those skilled in the art.

3. Carbon Dioxide-Philic CMP Polishing Slurries ($CO_2$-Philic Slurries).

For certain processes according to the present invention as described herein, a carbon dioxide-philic slurry (hereinafter "$CO_2$-philic slurry") is employed. For such slurries one or more solvents other than $CO_2$ are typically employed as the solvent system. Suitable solvents include the same as those described above as co-solvents for the $CO_2$-based slurries described above. The slurry may be nonaqueous, may contain minor amounts of water as a co-solvent (e.g., contain 0.1 to 0.2% by weight water), or may be aqueous (e.g., contain 2 or 5 to 30 or 90% by weight water).

Carbon dioxide soluble polymers. For certain processes according to the present invention as described herein, a $CO_2$-philic slurry including carbon dioxide soluble polymers (hereinafter "soluble polymers slurry") is employed. The soluble polymer slurry includes one or more polymers which are soluble in $CO_2$ and are carried by the $CO_2$-philic fluid base (the solvent). In general, a carbon dioxide soluble polymer or $CO_2$-philic polymer is one with appreciable solubility in dense carbon dioxide (for example, [c]>0.1 w//v %). Such polymers may include, but are not limited to, fluorine-containing polymers, siloxane-containing polymers, poly (ether-carbonate)-containing polymers, acetate polymers such as vinyl acetate-containing polymers, poly (ether ketone)-containing polymers and mixtures thereof. Examples include, but are not limited to, those described in U.S. Pat. No. 5,922,833 to DeSimone; U.S. Pat. No. 6,030,663 to McClain et al.; and T. Sarbu et al., *Nature* 405, 165–168 (11 May 2000).

Additional ingredients. The $CO_2$-philic slurry may include each of the various additional ingredients discussed above with respect to the $CO_2$-based slurry carried in the $CO_2$-philic fluid base. Amounts may be the same as indicated above. For example, the $CO_2$-philic slurry may contain abrasive particles, etchants, carboxylate salts, cosolvents, chelating agents, surfactants, rheology modifiers and/or the slurry ingredients as set forth above.

4. Planarization Apparatus.

The planarizing steps of each of the processes described herein may be executed using any suitable CMP apparatus. According to certain preferred embodiments of the invention, apparatus as described below are used to accomplish the CMP steps. It will be appreciated from the descriptions of the processes that follow that certain features or aspects of the apparatus as described below may be omitted or modified.

According to certain preferred embodiments, an apparatus 10 as shown in FIG. 1 may be used. The apparatus 10 employs a rotating CMP pad 32 as discussed in more detail below.

The apparatus 10 comprises a pressure vessel 21 having a door and port 21B and defining an interior, enclosed chamber 21A therein. A vacuum pump or compressor may be provided to remove air from the pressure vessel 21. In order to accommodate the pressurized atmosphere and prevent or reduce escape of $CO_2$ and the like, the pressure vessel 21 may be provided with suitable seals, sealable doors and ports and other devices. The pressure vessel 21 may be provided with a system of air-locks and/or $CO_2$ recycling and control means. $CO_2$ may be collected from the air-locks and recycled using a pump, compressor, heat or the like. Such provisions may be particularly advantageous if a relatively high throughput and insertion and removal of wafers is desired.

An atmosphere of carbon dioxide is maintained within the vessel 21. A $CO_2$ transfer device 22 is fluidly connected to a supply of $CO_2$ 20. The transfer device 22 may be a pressure pump, a compressor, a heat exchanger or other suitable apparatus. The transfer device 22 is operable to force the $CO_2$ into the vessel 21 via a line 24 using a differential pressure. The line 24 is selectively closeable by means of a valve 23. Optionally, the atmosphere within the vessel 21 may also include one or more additional gases, which may include inert gases such as helium, nitrogen, argon and oxygen. Cosolvents may be provided in the $CO_2$ supply 20 or may be added in the same manner as other gases. Optionally, the vessel 21 may contain additional fluids that are significantly ([c]<0.1 w/v %) insoluble in the $CO_2$-based fluid such as water. Multiple pumps or other transfer devices and gas supplies may be included if desired.

As shown, a substrate or wafer 25 (for example, a semiconductor wafer) to be planarized is securely mounted on a carrier 26 such that the wafer 25 is moveable with the carrier 26. The carrier is operatively connected to a motor 27, which is operable to rotate the carrier 26 and the wafer 25 in a direction A.

A polishing platen 31 carries the polishing pad 32, both of which are rotatable by a motor 33 in a counter direction B. The wafer engaging surface of the polishing pad 32 is preferably substantially planar. The polishing pad 32 may be formed of a foamed polymer (such as poly(urethane)) or felt, for example. The polishing pad 32 may be formed of a polymer film or chunk that is foamable or swellable by the $CO_2$ of the $CO_2$-based slurry. In this manner, the $CO_2$ may improve the performance and/or rejuvenate the pad during each use cycle.

A slurry supply 35 is fluidly connected to the vessel 21 interior by a line 37, which is selectively closeable by means of a valve 36. The end of the line 37 is positioned to deposit the slurry 35A on the polishing pad 32.

A pressure sensor 41 is connected to the vessel 21 by a line 42. The pressure sensor 41 is operatively associated with a pressure controller 43 for controlling a valve 44. The valve 44 can in turn control the pressure within the vessel 21 to maintain the vessel pressure at a desired level by selectively releasing vapor from the vessel 21 through a line 45. The pressure control apparatus may be implemented in any of a variety of manners and may incorporate features known in the art, including but not limited to those described in U.S. Pat. No. 5,329,732 to Karlsrud et al., U.S. Pat. No. 5,916,012 to Pant et al. or U.S. Pat. No. 6,020,262 to Wise et al., the disclosures of which are incorporated herein by reference.

Optionally, the apparatus 10 includes a still 51. The still 51 is fluidly connected to the vessel 21 by a line 52, which is closeable by means of a valve 53. The still 51 may be used to collect used slurry from the vessel 21. Additional waste storage vessels can be included upstream of the still 51 if desired, and the distillation process may be carried out in a batch or continuous fashion. By distilling the used slurry as described below, a concentrated waste 54 can be separated from the carbon dioxide 55 and recycled or disposed of by any suitable means. The carbon dioxide collected from the distillation process can be discarded or recycled for the preparation of a new batch of slurry.

The apparatus 10 may be used in the following manner to planarize a surface 25A of the wafer 25. The wafer 25 is inserted into the chamber 28A through the door and port 21B. The wafer 25 is securely mounted on the carrier 26, for example, by differential pressure leads, pins, clamps, adhesives or the like. The motor 27 is operated to drive the carrier 26 and the wafer 25 in the direction A and the motor 33 is operated to simultaneously drive the platen 31 and the polishing pad 32 in the direction B. In the case of the method as described below wherein an atmosphere of $CO_2$ is provided, the atmospheric $CO_2$ is supplied to the vessel 21 by the $CO_2$ transfer device 22 from the $CO_2$ supply 20.

The valve 36 is operated to selectively deposit quantities of the slurry 35A onto the pad 32 alongside the wafer 25. Preferably, the slurry 35A is deposited on the pad 32 concurrently with the rotation of the pad 32 and the wafer 25. The slurry may be deposited on the pad 32 continuously, periodically or only as needed. Rotation of the platen draws the slurry 35A into the interface between the wafer 25 and the pad 32 to facilitate the chemical mechanical planarization of the wafer 25.

The end point of the planarization process can be detected by any suitable means, including but not limited to those described in U.S. Pat. No. 5,637,185 to Murakara et al. (electrochemical potential measurement); U.S. Pat. No. 5,217,586 to Datta et al. (coulometry or tailoring bath chemistry); U.S. Pat. No. 5,196,353 to Sandhu et al. (surface temperature measurement); U.S. Pat. No. 5,245,522 to Yu et al. (reflected acoustic waves); and U.S. Pat. No. 5,242,524 to Leach et al. (impedance detection).

After the wafer surface 25A is sufficiently polished or planarized, the wafer 25 is removed from the carrier 25 and the pressure vessel 21 for further processing. The used slurry is collected through the line 52 and directed to the still 51.

The relative positions of the carrier 26 and the pad 32 are selected or adjusted to provide a prescribed engagement pressure (or an engagement pressure within a prescribed range) between the wafer surface 25A and the engaging (including fluid-planing) surface of the pad 32. The prescribed pressure should be sufficient to cause the pad 32 and the slurry 35A to polish the surface 25A during the process described above. The preferred engagement pressure will depend on the characteristics of the pad 32, the surface 25A and the slurry 35A. Likewise, the speeds of rotation of the platen 31 and the carrier 26 will vary depending on the characteristics of the pad 32, the surface 25A and the slurry 35A.

Preferably, in the methods and apparatus described below utilizing a $CO_2$ atmosphere during the CMP step, the transfer device 22 and the pressure controller 43 maintain the vessel at a pressure greater than atmospheric pressure. More preferably, the transfer device 22 and the pressure controller 43 maintain the vessel at a pressure of between about 10 and 10,000 psig. Preferably, the interior of the vessel is maintained at a temperature of between about −53° C. and 30° C.

Figure 2:
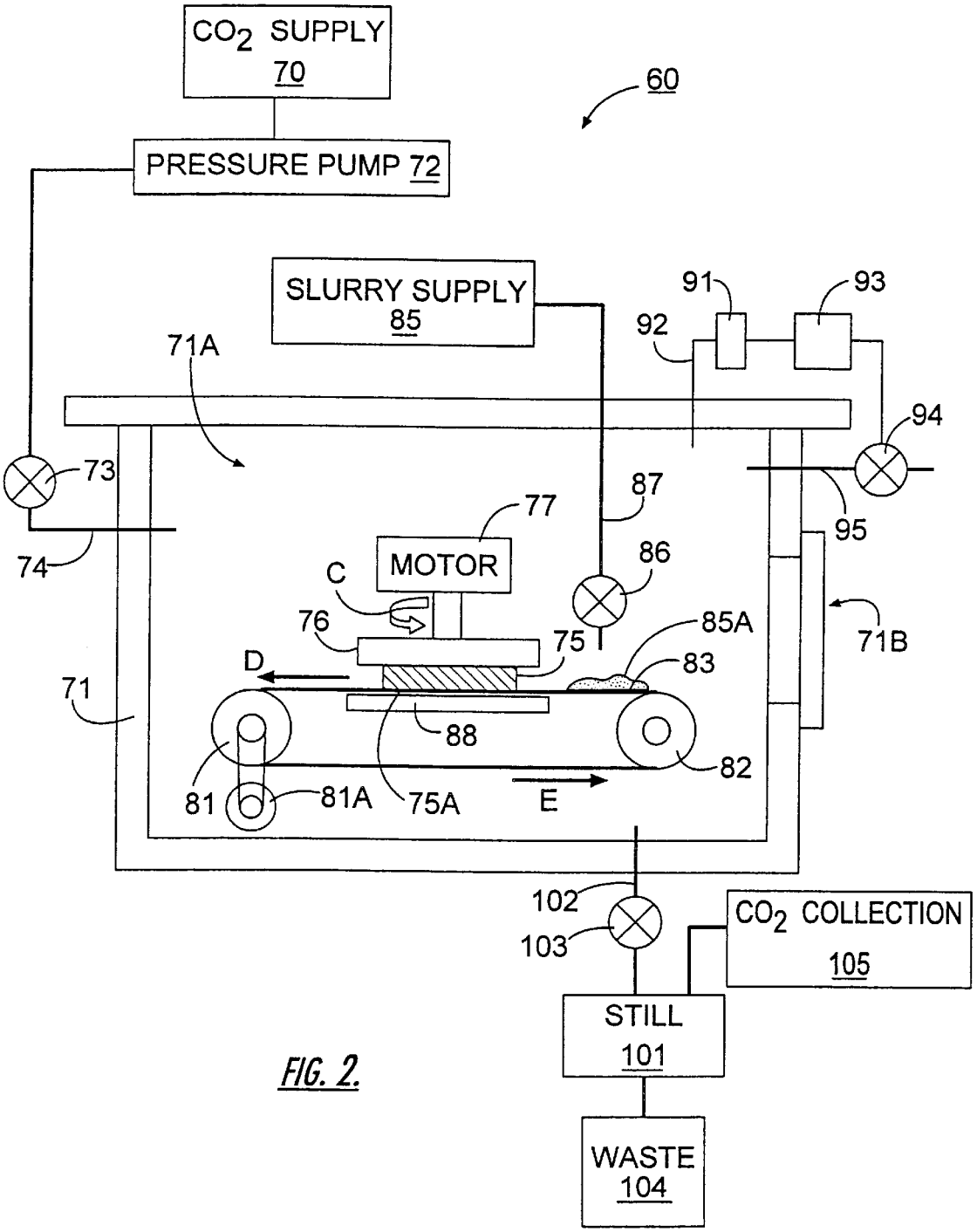
FIG. 2 is a schematic illustration of an alternative embodiment of an apparatus of the present invention, with the planarization steps being carried out with a linear continuous belt within a pressure vessel.

With reference to FIG. 2, an apparatus 60 according to further embodiments of the invention is shown therein. The apparatus 60 includes elements 70, 71, 71A, 71B, 72, 73, 74, 75, 76, 77, 85, 85A, 86, 87, 91, 92, 93, 94, 95, 101, 102, 103, 104 and 105 corresponding to elements 20, 21, 21A, 21B, 22, 23, 24, 25, 26, 27, 35, 35A, 36, 37, 41, 42, 43, 44, 45, 51, 52, 53, 54 and 55, respectively, of the apparatus 10. The apparatus 60 employs a continuous, endless polishing belt pad 83 mounted on rollers 81, 82. The roller 81 is drivable by a motor 81A to rotate the belt pad 83 such that the upper reach of the belt pad 83 is linearly moved in a direction D and the lower reach of the belt pad 83 is linearly moved in a counter direction E. Other suitable drive means may be used to drive the belt pad 83.

The apparatus 60 may be used in the following manner to planarize a surface 75A of the wafer 75. The substrate or wafer 75 to be planarized is securely mounted on the carrier 76 such that the wafer 25 is movable with the carrier 76. The motor 77 rotates the carrier 76 and the wafer 75 in a direction C. The motor 81A drives the belt pad 83 linearly in the directions D and E. Slurry 85A from the slurry supply 85 is deposited from the line 87 onto the belt pad 83 alongside the wafer 75. As the belt pad 83 is driven, the slurry 85A is drawn between the belt pad 83 and the proximate surface of the wafer 75. A platen 88 braces the belt pad 83 to provide the desired pressure between the belt pad 83 and the surface 75A of the wafer 75. The method using the apparatus 60 may otherwise be executed, modified and/or supplemented in the manners described above with respect to the method using the apparatus 10.

The foregoing apparatus 10, 60 may be modified such that the slurry 35A, 85A is fed through the platen 31 and the pad 32 or through the platen 88 and the pad 83. Preferably, the pads 32, 83 are substantially uniformly porous. The slurry 35A, 85A may provide a downward pressure against the pad 32, 83 to push the pad 32, 83 against the wafer 25, 75.

The motors 27, 33, 77, 81A may be selected and mounted in various ways. For example, a canned motor or a hydraulic (fluid driven) motor may be used and mounted inside the pressure vessel 21, 71. Alternatively, a magnetic coupled motor or a sealed shaft motor may be employed and mounted outside of the pressure vessel 21, 71.

As discussed below, in certain preferred methods, the wafer 25, 75 is cleaned using a solvent of carbon dioxide. Such a cleaning step is particularly desirable if the applied slurry 35A, 85A is a $CO_2$-philic slurry. The apparatus employed for the $CO_2$ cleaning step (hereinafter referred to as a "$CO_2$ solvent cleaning apparatus" and indicated by reference numeral 112 in FIGS. 3–6) may be an apparatus as disclosed in U.S. Pat. No. 6,001,418 to DeSimone and Carbonell, the disclosures of which are hereby incorporated herein by reference. The wafer 25, 75 may be manually or robotically transferred from the carrier 26, 76 to the cleaning apparatus. The cleaning step may be executed in the vessel 21, 71 or a further pressure vessel. Preferably, the atmosphere in the appropriate vessel is maintained at a pressure greater than atmospheric pressure. More preferably, the atmosphere in the cleaning vessel is maintained at a pressure of between about 10 and 10,000 psig. Preferably, the interior of the cleaning vessel is maintained at a temperature of between about −53° C. and 30° C. or between about 35° C. and 100° C. Preferably, the $CO_2$ solvent is provided in the cleaning operation as dense $CO_2$, and more preferably, as compressed liquid $CO_2$ or supercritical $CO_2$.

The apparatus 10, 60 may include suitable associated apparatus for recovering the $CO_2$ vapor from the pressure vessel 21, 71 to empty the pressure vessel following the planarizing process. Suitable means include compressors, condensers, additional pressure vessels and the like.

Each of the apparatus 10, 60 described above or other suitable apparatus may be used in sequential, multiple step procedures. For example, the apparatus 10, 60 may be used to planarize the wafer 25, 75 using a first set of selected parameters and materials. The wafer may then be polished using the same apparatus 10, 60 without removing the wafer from the platen. Alternatively, the sequential planarizing and polishing procedures may be conducted using a different apparatus for each of the planarizing and polishing procedures. The selected parameters for the polishing procedure may be different than the selected parameters for the planarizing procedure. For example, a different slurry, pad material, pad pressure, rotation or belt speed, and/or slurry flow rate may be used. Either the planarizing procedure or the polishing procedure may be conducted using a slurry that is neither $CO_2$-based nor $CO_2$-philic, for example, a water-based slurry.

Where different slurries are used for each procedure, one or both procedures may be conducted using a $CO_2$-based slurry. The foamability or swellabililty of the pad may be used to control the force of contact between the pad and the wafer. Where a foamable or swellable pad is used, the polishing step may use a slurry having a higher concentration of $CO_2$ so that the pad is made softer as compared to its state in the planarizing step. The planarizing procedure may be conducted using a slurry that does not significantly foam or swell the pad. The pad may be a composite pad having a swellable body and a layer of abrasive particles on the wafer contacting surface thereof. During the planarizing step, the harder pad body provides a relatively stiff backing for the abrasive particles so that the abrasive particles contact the wafer surface. During the polishing step, when the pad body is softened, the softer (i.e., more pliable) pad body allows the abrasive particles to be pushed back into the pad body so that the abrasive particles do not engage the wafer surface or engage the wafer surface with less pressure. The swellable pad body may swell to surround a portion or substantially all of the abrasive particles so that the surrounded abrasive particles do not directly contact the wafer.

The apparatus 10, 60 may be modified such that the wafers 25, 75 are not spun but rather are maintained in a static position while being operated on by the pad 32, 83. In addition to or in place of the pads 32, 83 and/or the rotation of the wafers 25, 75, the slurry 35A, 85A may be delivered in a manner that effectuates planarization. More particularly, the slurry may be directed at the wafer surface at a selected pressure and/or flow rate that causes the slurry to directly abrade the wafer surface. For this purpose, the slurry may be $CO_2$-based, $CO_2$-philic or water-based. Such an apparatus and method may be provided wherein no moving parts are present (i.e., no pads are used and the wafer is held stationary) or wherein the wafer is merely rotated without contacting any pad. The wafer may be sequentially planarized and polished as discussed above by using different slurries, different slurry pressures and/or different slurry flow rates. For example, a first slurry having a relatively high concentration of abrasive particles may be used for the planarizing procedure, followed by the use of a second slurry having a relatively lower concentration of abrasive particles for the polishing procedure.

In order to capture or direct metallic particles (e.g., charged copper particles dislodged from the wafer by the planarizing procedure) away from the wafer, an electric field may be provided in the vessel 21, 71. For example, a voltage may be applied through the pad to bias negative ion particles from the wafer surface.

5. Methods Including CMP Using $CO_2$-Philic Slurry without $CO_2$ Present.

Figure 3:
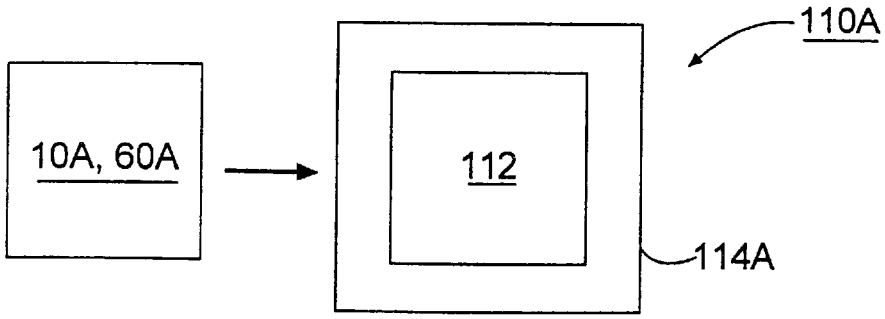
FIG. 3 is a schematic illustration of a CMP system according to the present invention.

With reference to FIG. 3, a CMP system 110A according to embodiments of the present invention is shown therein. The system 110A includes a CMP apparatus 10A, 60A corresponding to either of the CMP apparatus 10, 60 described above and modified as described below. The system 110A also includes a $CO_2$ solvent cleaning apparatus 112 as discussed above. A pressure vessel 114A houses the cleaning apparatus 112.

The CMP apparatus 10A, 60A differs from the CMP apparatus 10, 60 in that no $CO_2$ supply/pressurizing components (i.e., elements 20, 22–24 and 41–45 or elements 70, 72–74 and 91–95) or still components (i.e., elements 51–55 or elements 101–105) are provided. The pressure vessel 21, 71 may be included in the apparatus 10A, 60A, may be replaced with a non-pressure vessel or may be omitted.

In the CMP system 110A, the slurry 35A, 85A dispensed from the slurry supply 35 is a $CO_2$-philic slurry as described above. Preferably, the $CO_2$-philic slurry is a carbon dioxide soluble polymer slurry as described above.

The system 110A may be used as follows. The wafer 25, 75 is planarized by the apparatus 10A, 60A using the $CO_2$-philic slurry without a surrounding atmosphere having an enhanced $CO_2$ level. More particularly, the proportion or amount of $CO_2$ present in the surrounding atmosphere does not exceed the proportion or amount of $CO_2$ in the ambient air or reflective of common atmospheric conditions. The planarized wafer 25, 75 is then transferred to the $CO_2$ solvent cleaning apparatus 112 where it is cleaned in a $CO_2$ atmosphere using a $CO_2$ cleaning solvent (preferably, a dense $CO_2$ solvent).

Figure 4:
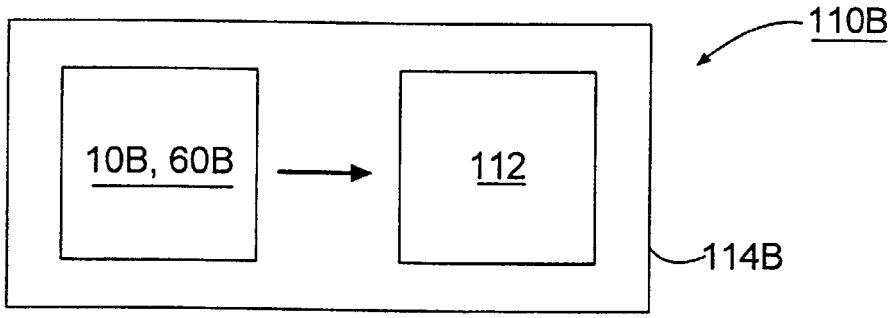
FIG. 4 is a schematic illustration of a CMP system according to a further embodiment of the present invention.

With reference to FIG. 4, a CMP system 110B according to further embodiments is shown therein. The CMP system 110B includes a CMP apparatus 10B, 60B corresponding to the apparatus 10A, 60A. The system 110B differs from the system 110A in that the CMP apparatus 10B, 60B is housed in a common pressure vessel 114B with the cleaning apparatus 112.

6. Methods Including CMP Using $CO_2$-Philic Slurry with $CO_2$ Present.

Figure 5:
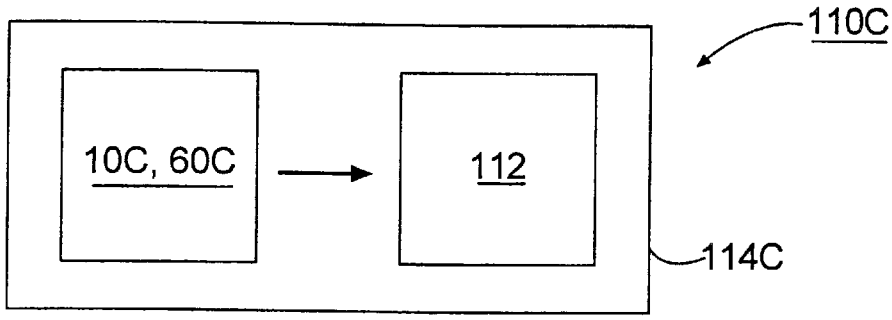
FIG. 5 is a schematic illustration of a CMP system according to a further embodiment of the present invention.

With reference to FIG. 5, a CMP system 110C according to further embodiments of the present invention is shown therein. The system 110C includes a CMP apparatus 10C, 60C corresponding to the apparatus 10, 60 and wherein the slurry 35A, 85A is a $CO_2$-philic slurry (preferably a soluble polymer $CO_2$-philic slurry). The system 110C also includes a $CO_2$ solvent cleaning apparatus 112. Preferably, the CMP apparatus 10C, 60C and the cleaning apparatus 112 are housed in a common pressure vessel 114C as shown. The pressure vessel 114C may substitute for the pressure vessel 21, 71 in the CMP apparatus 10C, 60C. Alternatively, in lieu of or in addition to the common pressure vessel 114C, the CMP apparatus 10C, 60C may include the pressure vessel 21, 71 and the cleaning apparatus 112 may be housed in a separate pressure vessel.

The CMP system 110C may be used as follows. The wafer 25, 75 is planarized by the CMP apparatus 10C, 60C using the $CO_2$-philic slurry in an atmosphere of $CO_2$ as discussed above, which may be supplied by the transfer device 22 from the $CO_2$ supply 20. The planarized wafer 25, 75 is then transferred to the cleaning apparatus 112 where it is cleaned in a $CO_2$ atmosphere using a $CO_2$ cleaning solvent. Optionally, the $CO_2$ solvent cleaning step and the cleaning apparatus 112 may be omitted from the aforedescribed method and the system 110C.

7. Methods Including CMP Using $CO_2$-Based Slurry.

Figure 6:
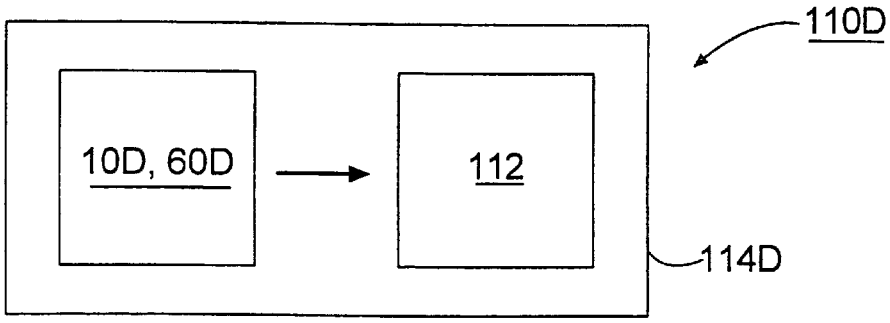
FIG. 6 is a schematic illustration of a CMP system according to a further embodiment of the present invention.

With reference to FIG. 6, a CMP system 110D according to further embodiments of the present invention is shown therein. The system 110D includes a CMP apparatus 10D, 60D corresponding to either of the CMP apparatus 10, 60 and wherein the slurry 35A, 85A is a $CO_2$-based slurry as described above. The system 110D also includes a $CO_2$ solvent cleaning apparatus 112. Preferably, the CMP apparatus 10D, 60D and the $CO_2$ cleaning apparatus 112 are housed in a common pressure vessel 114D as shown. The pressure vessel 114D may substitute for the pressure vessel 21, 71 in the CMP apparatus 10D, 60D. Alternatively, in lieu of or in addition to the common pressure vessel 114D, the CMP apparatus 10D, 60D may include the pressure vessel 21, 71 and the cleaning apparatus 112 may be housed in a separate pressure vessel.

The CMP system 110D may be used as follows. The wafer 25, 75 is planarized by the CMP apparatus 10D, 60D using the $CO_2$-based slurry in an atmosphere of $CO_2$ as discussed above. The wafer 25, 75 is then transferred to the cleaning apparatus 112 where it is cleaned in a $CO_2$ atmosphere using a $CO_2$ cleaning solvent (preferably, a liquid $CO_2$ solvent). Optionally, the $CO_2$ solvent cleaning step and the cleaning apparatus 112 may be omitted from the aforedescribed method and system 110D.

8. Post-CMP Cleaning.

Whether cleaned by a solvent comprising carbon dioxide, water, and/or other materials, the cleaning step in the processes described above is carried out so as to be sufficient for the particular use of the article being planarized. Moreover, particulates such as those generated in the CMP process as well as abrasives used in the CMP process should be removed to prevent or reduce defects which may be caused by such particles. Cleaning may be by any suitable technique, including but not limited to brush scrubbing, hydrodynamic jets or other fluid jets, acoustic ultrasonic and megasonic energy. For example, cleaning may be carried out as described in U.S. Pat. No. 5,866,005 to DeSimone et al. When desired, the back side of the article or wafer may also be cleaned. For the planarization of metals in general, the amount of trace metal ions remaining on the surface after planarization and cleaning is preferably not more than about $10^{10}$ (or $10^{12}$) atoms/centimeter$^2$; for the planarization of copper (such as in dual-damascene copper articles) the amount of residual copper on field oxides after planarization and cleaning is preferably not more than about 1 (or 2 or 4)$\times 10^{13}$ atoms/centimeter$^2$. Additives that may be included in the cleaning solvent include, but are not limited to, surfactants (including surfactants containing a $CO_2$-philic group), chelating agents, etc.

9. Separation Steps.

A particular advantage of the present invention is the ease with which the $CO_2$-based slurry, the $CO_2$ collected in the $CO_2$-philic slurry, and the $CO_2$ of the $CO_2$ solvent may be separated from contaminants and waste (which may include toxic ingredients and difficult to manage fine particulate contamination) after the planarization process (and, where applicable, the cleaning process). For example, if distillation of the carbon dioxide solvent or effluent is carried out under pressure (i.e., a pressure greater than atmospheric pressure), the carbon dioxide may be readily fractionated or separated from the other constituent ingredients. When distillation of the liquid slurry is carried out at room temperature, a pressure of 700 to 850 pounds per square inch (psig) is suitable. When distillation of the liquid slurry is carried out under cryogenic conditions (e.g., at a temperature of about −10° F. to 0° F.), then a pressure of about 200 to 300 psig is suitable. The $CO_2$ may also be separated from contaminants and waste using filtration or momentum-based techniques and devices such as centrifugation or a cyclone.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A method for the chemical mechanical planarization of a surface of an article, said method comprising the steps of:

providing a carbon dioxide-philic polishing slurry;

providing a polishing pad;

contacting the polishing pad and the polishing slurry against the surface of the article to thereby planarize the surface of the article; and cleaning the surface of the article with a solvent comprising carbon dioxide.

2. The method according to claim 1 wherein the solvent comprises dense carbon dioxide.

3. The method according to claim 1 wherein said contacting step is executed in an atmosphere not including carbon dioxide in an amount exceeding common atmospheric conditions.

4. The method according to claim 1 wherein said contacting step and said cleaning step are executed in a common pressure vessel.

5. The method according to claim 1 wherein the polishing slurry includes a polymer that is soluble in carbon dioxide.

6. The method according to claim 5 wherein the polymer is selected from the group consisting of fluoropolymers, siloxane polymers, vinyl acetate polymers, and poly (ether ketone) polymers.

7. The method according to claim 1 wherein said cleaning step is executed in an atmosphere comprising carbon dioxide at a pressure greater than atmospheric pressure.

8. The method according to claim 1 wherein said cleaning step is executed at a pressure of from about 10 to 10,000 psig.

9. The method according to claim 1 wherein said cleaning step is executed at a temperature of from about −53° C. to about 30° C.

10. The method of claim 1 wherein the article is a semiconductor wafer.

11. A method for the chemical mechanical planarization of a surface of an article, said method comprising the steps of:

providing a carbon dioxide-philic polishing slurry;

providing a polishing pad; and contacting the polishing pad and the polishing slurry against the surface of the article to thereby planarize the surface of the article;

wherein said contacting step is executed in an atmosphere comprising carbon dioxide at a pressure greater than atmospheric pressure.

12. The method according to claim 11 wherein the polishing slurry includes a polymer that is soluble in carbon dioxide.

13. The method according to claim 11 wherein the polymer is selected from the group consisting of fluoropolymers, siloxane polymers, vinyl acetate polymers, and poly (ether ketone) polymers.

14. The method according to claim 11 including the step of cleaning the article with a solvent comprising carbon dioxide.

15. The method according to claim 14 wherein said contacting step and said cleaning step are executed in a common pressure vessel.

16. The method according to claim 14 wherein said cleaning step is executed in an atmosphere comprising carbon dioxide at a pressure greater than atmospheric pressure.

17. The method according to claim 14 wherein said cleaning step is executed at a pressure of from about 10 to 10,000 psig.

18. The method according to claim 14 wherein said cleaning step is executed at a temperature of from about −53° C. to about 30° C.

19. The method of claim 14 wherein the article is a semiconductor wafer.

20. An apparatus for the chemical mechanical planarization of a surface of an article, said apparatus comprising:

a) a polishing pad;

b) a carbon dioxide-philic polishing slurry; and c) an article holding member to hold the article such that the surface of the article can be contacted with said polishing pad and said polishing slurry.

21. An apparatus according to claim 20 wherein the polishing slurry includes a polymer that is soluble in carbon dioxide.

22. An apparatus according to claim 21 wherein the polymer is selected from the group consisting of fluoropolymers, siloxane polymers, vinyl acetate polymers, and poly (ether ketone) polymers.

23. An apparatus according to claim 20 further including a cleaning apparatus including carbon dioxide solvent and operative to contact said carbon dioxide solvent with the surface of the article.

24. A chemical mechanical planarization (CMP) polishing slurry comprising:

(a) from 1 to 20 percent by weight of abrasive particles;

(b) from 0.1 to 50 percent by weight of etchant;

(c) at least 30 percent by weight of solvent; and (d) from 1 to 20 percent by weight of a carbon dioxide soluble polymer.

25. The CMP polishing slurry according to claim 24 wherein said polymer is selected from the group consisting of fluoropolymers, siloxane polymers, vinyl acetate polymers, and poly (ether ketone) polymers.

26. The CMP polishing slurry according to claim 24 wherein said abrasive particles have a mean particle diameter of from about 10 nanometers to about 800 nanometers.

27. The CMP polishing slurry according to claim 24 wherein said abrasive particles are formed of a material selected from the group consisting of silica, metals, metal oxides, and combinations thereof.

28. The CMP polishing slurry according to claim 24 wherein said abrasive particles are formed of at least one metal oxide abrasive selected from the group consisting of alumina, ceria, germania, silica, titania, zirconia, and mixtures thereof.

29. The CMP polishing slurry according to claim 24 wherein said etchant is a selected from the group consisting of potassium fluoride, hydrogen fluoride, hydroxides, and acids.

30. The CMP polishing slurry according to claim 24 wherein said solvent comprises an aqueous solvent.

31. The CMP polishing slurry according to claim 24 wherein said solvent is non-aqueous.

32. The CMP polishing slurry according to claim 24 wherein said solvent comprises an organic solvent.

* * * * *